United States Patent [19]

McMahon

[11] Patent Number: 4,738,098

[45] Date of Patent: Apr. 19, 1988

[54] SAFETY TIMER FOR TURBINE POWERED HELICOPTER

[76] Inventor: Brian McMahon, 8351 Ronda Dr., Canton, Mich. 48187

[21] Appl. No.: 30,085

[22] Filed: Mar. 26, 1987

[51] Int. Cl.[4] ..... F02C 7/00

[52] U.S. Cl. ..... 60/39.091; 244/17.11

[58] Field of Search ..... 60/39.091, 39.13; 244/17.11, 17.13, 17.17

[56] References Cited

U.S. PATENT DOCUMENTS

| | | | |
|---|---|---|---|
| 3,691,759 | 9/1972 | Scheeren | 60/39.091 |
| 4,619,110 | 10/1986 | Moore | 60/39.091 |
| 4,638,630 | 1/1987 | Martens et al. | 60/39.182 |

*Primary Examiner*—Louis J. Casaregola

*Attorney, Agent, or Firm*—Charles W. Chandler

[57] ABSTRACT

A timing device to automatically timing the turbine engine cool-down period for a turbine engine helicopter. The electronic timer is activated when the microswitch on the engine throttle cable is closed, as the pilot twists the throttle control to the ground-idle position. The timer illuminates a yellow caution light on the helicopter instrument panel to indicate to the pilot that the cooling cycle is in progress. The timer is preset to the specified time limits required by the turbine engine manufacturer for the helicopter. At the end of the cool-down period, the timer deactivates the caution light on the helicopter instrument panel and indicates to the pilot that the cooling cycle is complete and the turbine engine can be shut down.

2 Claims, 1 Drawing Sheet

SAFETY TIMER FOR TURBINE POWERED HELICOPTER

BACKGROUND OF THE INVENTION

This invention is related to a timing device for indicating the expiration of a cool-down period for turbine powered helicopters.

Unlike turbine-powered fixed-wing aircraft which taxis in after they land, with their engines idling at low power, a turbine powered helicopter uses high engine power until it has completed landing. For this reason, helicopter pilots experience a problem unique to turbine-powered helicopters, and are instructed to cool-down their turbine engines for a specified time period after landing to reduce thermal shock to turbine engine components. Helicopter pilots are often distracted from monitoring the engine cooling period because of disembarking passengers or other duties. This results in premature turbine engine shut-downs, or wasted fuel from pilots mentally over-estimating the cool-down period.

SUMMARY OF THE INVENTION

The broad purpose of the present invention is to provide a timing device actuated by the helicopter turbine engine throttle for indicating the cool-down period for a turbine powered helicopter. The preferred embodiment of the invention helps to prevent damage to turbine engine components resulting from thermal shock and carbon build-up caused by an inadequate cool-down period. It reduces the helicopter operator's operating costs by eliminating the additional engine maintenance caused by lack of pilot adherence to turbine engine manufacturer's cooling cycle requirements.

The advantages are: (1) substantial savings for helicopter operators because of the reduced maintenance requirements when turbine engines are operated properly; (2) increased safety because proper operation of the turbine engine ensures greater reliability; and (3) reduced pilot workload.

Still further objects and advantages of the invention will become readily apparent to those skilled in the art to which the invention pertains upon reference to the following detailed description.

DESCRIPTION OF THE DRAWING

The description refers to the accompanying drawing in which like reference characters refer to like parts throughout the several views, and in which.

DESCRIPTION OF THE PREFERRED EMBODIMENT

Figure 1:
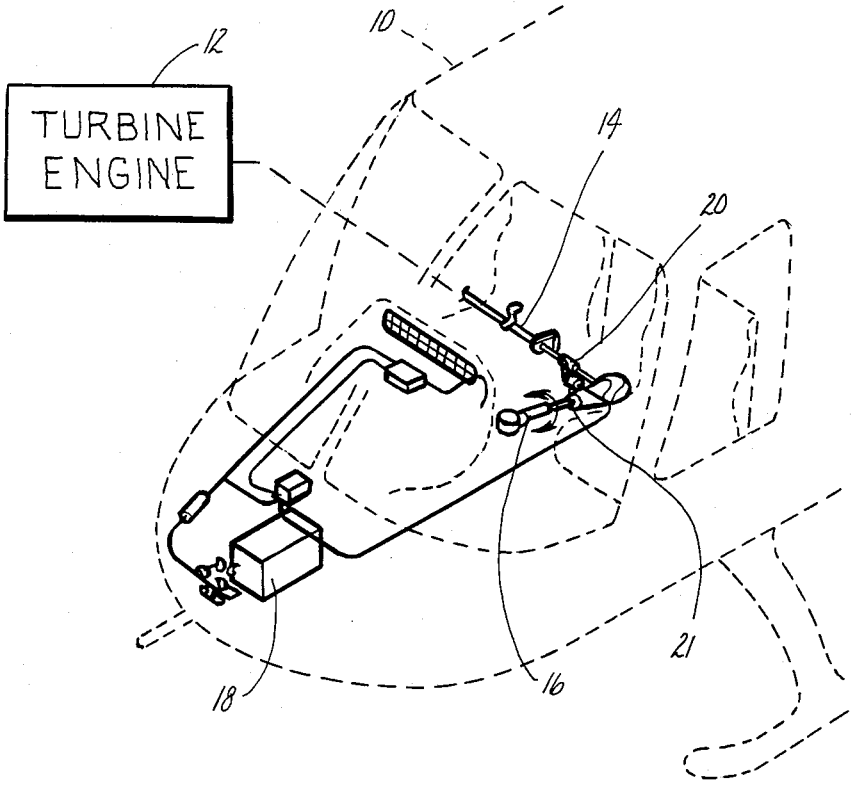
FIG. 1 illustrates the preferred embodiment of the invention installed in a turbine powered helicopter.

FIG. 1 illustrates the outline of a conventional helicopter 10 having turbine engine 12, illustrated diagrammatically, connected by an engine throttle control cable 14 to a manually-operated engine throttle 16. Throttle 16 is operated by the helicopter pilot such that when it is twisted in one direction, the turbine engines operate the helicopter rotors (not shown) in a ground-idle position in which the rotors are in motion, and when twisted in the opposite direction, the throttle cable is longitudinally moved in the opposite direction toward a position in which the turbine engines are in the shut down condition to terminate rotor motion. The helicopter also has a 24-volt electrical battery 18 which functions as a power source for electrical components in the helicopter in the manner well known to those skilled in the art.

Micro-switch 20 which functions as a triggering device, is mounted adjacent the engine throttle control cable on micro-switch bracket 21.

Figure 2:
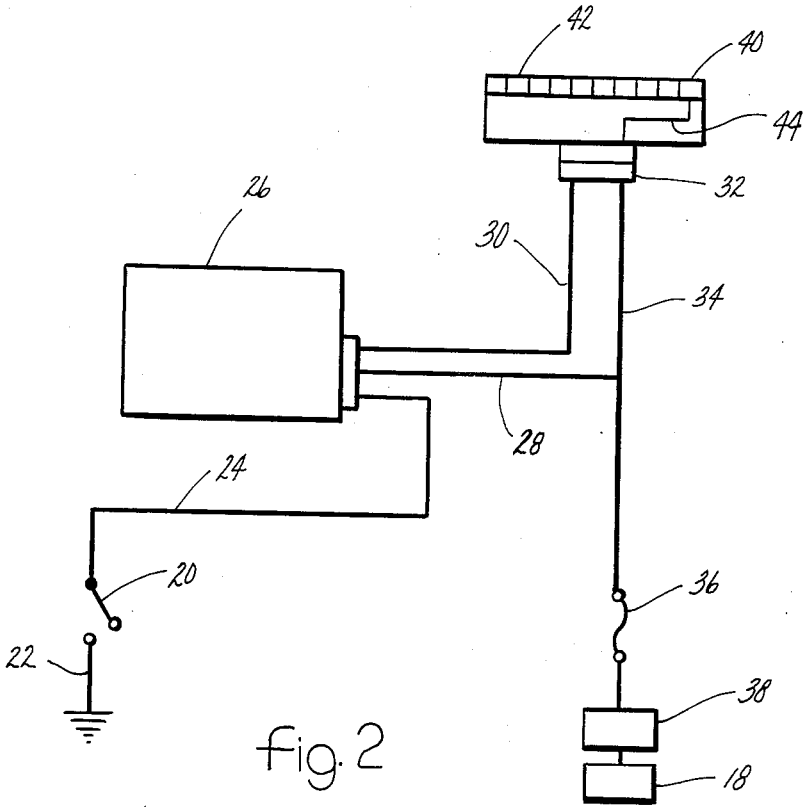
FIG. 2 illustrates a wiring diagram of the invention installed in the helicopter.

Referring to FIG. 2, switch 20 is grounded by electrical conductor 22. Another electrical conductor 24 connects switch 20 to conventional electronic timing device 26. Electrical conductor 28 connects the timing device to battery 18. Electrical conductor 30 connects the timing device to a caution panel connector assembly 32. Electrical conductor 34 connects caution panel connector assembly 32 to 24-volt fuse assembly 36, aircraft battery relay 38 and battery 18.

A two-minute yellow caution light 40, which forms part of a light assembly 42 on the helicopter's instrument panel, is connected by conductor 44 to panel connector assembly 32.

The timing device is activated when the helicopter pilot twists engine throttle 16 to the ground-idle position which in turn moves cable 14 so as to rotate the turbine powered rotors in an idling condition. The cable 14 engages and activates the micro-switch which, in turn, causes the caution light to illuminate for two minutes and then to automatically extinguish, indicating to the pilot that the cool-down period is complete. The turbine engines are then deactivated by opening the master battery switch (not shown).

Light 40 is either a press-to-test caution light installed on the helicopter's instrument panel, visible to the pilot, or one of the existing spare caution lights in the helicopter's master caution panel. The micro-switch, the timing device, and the caution light are all grounded in standard aircraft.

One of the advantages of the invention is that it overcomes a problem apparent to busy helicopter pilots because they often tend to under estimate the expiration of the two-minute cool-down period, therefore prematurely terminating the turbine powered rotors, and causing engine damage. The two-minute light automatically indicates to the pilot whether or not the two-minute period has expired. If it has expired, then the pilot can deactivate the engine.

Thus it is to be understood that I have described a novel solution to a problem unique to turbine-powered helicopters.

Having described my invention, I claim:

1. In combination with a turbine-powered helicopter having a turbine engine requiring a predetermined cooling period, and an engine throttle control means in the helicopter movable from a first position corresponding to a ground-idle condition in which the helicopter rotors are in motion, toward a second position corresponding to a shut-down condition in which the rotor motion is terminated, means for monitoring the turbine engine's cool-down period after the engine throttle control means are moved to said first position, and before the engine throttle control means are moved to said second position, comprising:

timing means connected to the engine throttle control menas so as to be activated for a predetermined cool-down period when the engine throttle control means are moved to the first position; and indicator means connected to the timing means for indicating to the user whether or not said predetermined cool-down period has elapsed after the throttle control means has been moved to the first position.

2. The combination as defined in claim 1, in which the indicator means comprises an electrically actuated lamp which is illuminated a predetermined time period after the engine throttle control means is moved to the first position.

* * * * *